US005092642A

United States Patent [19]

Lindmayer et al.

[11] Patent Number: 5,092,642

[45] Date of Patent: Mar. 3, 1992

[54] DOOR HANDLE FOR MOTOR VEHICLES WITH DAMPING ELEMENT

[75] Inventors: Martin Lindmayer, Böblingen; Klaus Claar, Sindelfingen, both of Fed. Rep. of Germany

[73] Assignee: Mercedes-Benz AG, Fed. Rep. of Germany

[21] Appl. No.: 585,946

[22] Filed: Sep. 21, 1990

[30] Foreign Application Priority Data

Sep. 23, 1989 [DE] Fed. Rep. of Germany ..... 3931866

[51] Int. Cl.[5] ..... E05B 3/00

[52] U.S. Cl. ..... 292/336.3; 292/DIG. 56; 292/201; 292/DIG. 73

[58] Field of Search ..... 292/DIG. 73, DIG. 56, 292/341.12, 336.3, 144, 201, 341.16, 92; 16/DIG. 6; 70/463

[56] References Cited

U.S. PATENT DOCUMENTS 1,688,472 10/1928 Shaw ..... 292/144
3,512,210 5/1970 Ratcliffe ..... 292/201
4,540,208 9/1985 Logan, Jr. et al. ..... 292/92

FOREIGN PATENT DOCUMENTS 2658159 7/1978 Fed. Rep. of Germany .
3403003 8/1985 Fed. Rep. of Germany .
2214556 9/1989 United Kingdom ..... 292/92

*Primary Examiner*—Renee S. Luebke
*Assistant Examiner*—Darnell Boucher
*Attorney, Agent, or Firm*—Evenons, Wands, Edwards, Lenahan & McKeown

[57] ABSTRACT

Motor vehicle door handle of the type having a spring biased actuating lever for activating the closing mechanism. To reduce impact noise, the actuating lever is assigned, during its return movement until its end position is reached, a damping element which exerts on the actuating lever a braking force reduced with decreasing speed of the actuating lever, thus allowing a uniform return of the actuating lever into its end position and consequently an effective minimization of the impact noise.

13 Claims, 1 Drawing Sheet

DOOR HANDLE FOR MOTOR VEHICLES WITH DAMPING ELEMENT

BACKGROUND AND SUMMARY OF THE INVENTION

The invention relates to a latching mechanism for a door handle for motor vehicles.

A door handle of the generic type for activating a closing device of a vehicle door is disclosed in German patent document DE-2,658,159,B2, in which the return of an actuating lever to its initial position after an actuation, takes place automatically by means of spring forces and is limited by a fixed stop. In order to reduce the generation of noise which occurs when the actuating lever returned by spring force strikes against the stops, an elastic intermediate layer forms a damping support for the limit stops.

Such passive elastic damping supports for a low-noise return of an actuating lever are in widespread use. The damping travel provided is very short, and exact positioning is made difficult by the tolerances and by phenomenon of material fatigue. Moreover, such materials, because of their elastic properties, do not allow a uniform soft return of the actuating lever into its initial position. The impact noise is therefore reduced only incompletely and unreliably.

The object o the present invention therefore is to provide a door handle of the above type which achieves a substantial and reliable reduction of impact noise.

This and other objects are achieved in a door handle according to the invention, wherein the actuating lever is coupled to a damping element during its return movement until it reaches its initial position in such a way that the damping element exerts on the actuating lever a force which is directed counter to the spring force and which, until a specific low speed of the actuating lever is reached, is greater than the spring force.

This speed-dependent deceleration of the actuating lever makes it possible to return the latter to its end position with minimal noise. At the same time, in contrast to the use of elastic materials as limit stops, all the more kinetic energy of the actuating lever is transferred to the damping element, the greater this energy is. The actuating lever is returned to its end position uniformly and softly. The limit stop is reached at a very low speed, and the greatest possible reduction of the impact noise is achieved thereby.

Other objects, advantages and novel features of the present invention will become apparent from the following detailed description of the invention when considered in conjunction with the accompanying drawings.

DETAILED DESCRIPTION OF THE DRAWINGS

Figure 1:
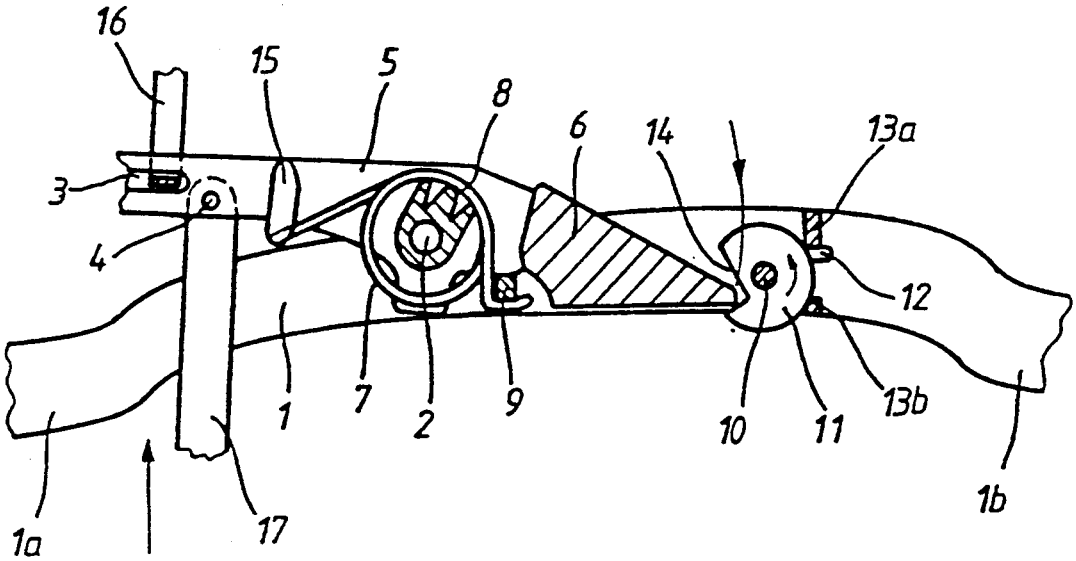
FIG. 1 shows a longitudinal section through an arrangement for the damped return of a door-actuating lever.

A door-actuating mechanism damped according to the invention is shown in FIG. 1. An exterior door handle, not shown, which is mounted pivotably at one end, engages at its other end through the door wall via the extension 17 and is articulated at the end 4 of the extension 17 on a lever 5. The lever 5 is mounted rotatably by means of the axle 2 and possesses an extension 6 serving as a mass counterweight connected firmly to it. The axle 2 is, like a further axle 10, mounted vertically on two horizontal retaining plates which are offset in parallel and between which the lever 5 is arranged, only the lower retaining plate 1 being shown in the sectional drawing. It is curved towards the vehicle interior according to the handle recess of the outer door wall and is connected in a way not shown in detail at the two end parts 1*a*, 1*b* to the upper retaining plate and attached to the inside of the outer wall of the vehicle door. Furthermore, limit stops 13*a*, 13*b*, which limit the rotational movement of the damping element 11 by means of a peg 12 attached to it, and a one-side fastening 9 for the spring 7 are mounted on the retaining devices. To force the return movement of the lever 5 and therefore of the exterior door handle into the initial position shown here, the spring 7, at its second end, is inserted prestressed into a clearance 15 of the lever 5 via the spacer mounting 8. The closing mechanism is coupled to the movement of the door handle via a clearance 3 of the lever 5, into which clearance the angled end of a rod 16 leading to the door lock engages.

After the exterior door handle has been actuated, the lever 5 is in a position rotated in the opposite direction to the direction of the arrow shown. After the exterior door handle has been released, the spring 7 via the lever 5, causes a return movement in the direction of the arrow shown. This first takes place without the action of the damping element 11, in this phase of movement there occurring the actuation of the closing mechanism, not shown here, which is coupled to the exterior door handle via the rod 16. However, before the lever 5 reaches its end position shown, the extension 6 engages into a clearance 14 of the damping element 11 and causes it to rotate about the axle 10. During this phase of movement, the damping element 11 exerts on the extension 6 a force which is dependent on its angular speed and which brakes the rotational movement of the lever 5 caused by the spring 7. The system thus reaches its end position at low speed with a braking travel which is comparatively long in comparison with elastic damping supports, thus making it possible to achieve effective noise reduction. During the actuation of the lever 5 from its end position, the damping element 11 is returned again via the extension 6 which engages into the recess 14. This at the same time prevents a material-damaging, abrupt lever actuation.

Of course, it is beneficial as an additional measure to equip the limit stops described with known passive damping supports, such as, for example, rubber supports.

Figure 2:
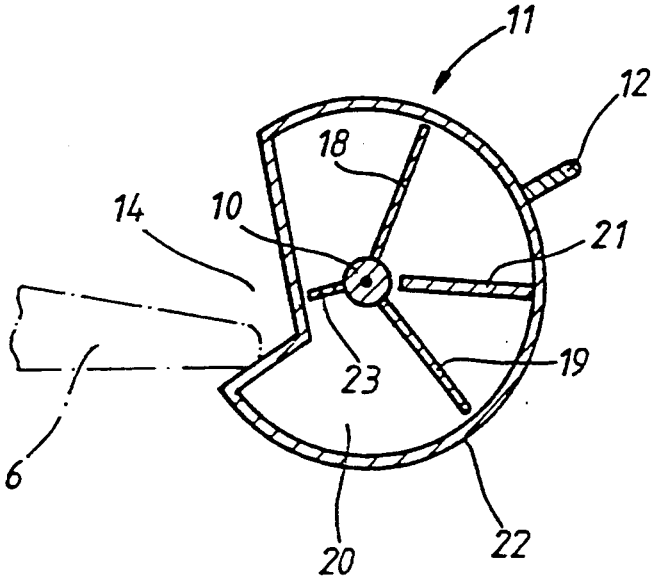
FIG. 2 shows an exemplary embodiment of the damping element of FIG. 1 which generates a speed-dependent damping force.

The damping element 11 can be designed as shown in FIG. 2. It consists of a cylinder-like box which has a bottom and a lid and which is mounted rotatably on the axle 10 guided through it. A recess 14 is arranged in the circular-cylindrical outer wall 22. The outwardly sealed-off cavity 20 inside the box is filled with a fluid of suitable viscosity. Rectangular wing plates 18, 19, 23 are attached to the fixed axle 10 in the cavity 20 and are designed as perforated plates. A corresponding wing plate 21 is connected firmly to the outer wall 22. During the rotation of the outer wall 22 in relation to the fixed axle 10, the fluid is obligated to flow through the orifices of the perforated plates. Thus, as is known, the resistance force exerted by the viscosity of the fluid increases as the relative speed becomes higher. The damping element therefore exerts the desired speed-dependent damping force on the extension 6.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. Door handle arrangement for actuating a closing device of a door of a motor vehicle comprising:

an actuating lever;

a stop spring means for causing a return movement of said actuating lever into an initial position defined by said stop following displacement of said actuating lever from said initial position;

a moveable damping element adapted to be coupled to said actuating lever at least shortly before said actuating lever reaches said initial position during said return movement, there being no coupling between said damping element and said actuating lever over a portion of the return movement of the actuating lever; said damping element exerting on said actuating lever a damping force which decreases with decreasing speed of the actuating lever, and which until shortly before said actuating lever reaches said initial position, is greater than a force of said spring means; said damping force being generated by means of viscous effects.

2. Door handle according to claim 1, wherein said movable damping element is rotatable.

3. Door handle according to claim 1, wherein the damping element is a hollow cylinder which is filled with a fluid and in which wings equipped with throttle orifices are arranged.

4. Door handle according to claim 2, wherein said actuating lever engages with a recess on a circumference of said damping element.

5. Door handle according to claim 3, wherein said actuating lever engages with a recess on a circumference of said damping element.

6. Door handle according to claim 5, wherein the actuating lever engages into said recess in both first and second directions of rotation of the damping element.

7. Door handle according to claim 1, wherein said stop engages with the damping element.

8. Door handle according to claim 6, wherein said stop engages with the damping element.

9. Door handle according to claim 8, wherein two fixed stops limit the movement of the damping element in both of said first and second directions by means of a projection protruding from said damping element.

10. Door handle according to claim 2, wherein an extension connected to said actuating lever engages with a recess on a circumference of said damping element.

11. Door handle according to claim 3, wherein an extension connected to said actuating lever engages with a recess on a circumference of said damping element.

12. Door handle according to claim 10, wherein said extension engages into said recess in first and second directions of rotation of said damping element.

13. Door handle according to claim 11, wherein said extension engages into said recess in first and second directions of rotation of said damping element.

* * * * *